United States Patent [19]

Werner

[11] Patent Number: 4,463,587

[45] Date of Patent: Aug. 7, 1984

[54] ARTICLE HANDLING ASSEMBLY FOR FORGING PRESSES HAVING A SPRAYING MECHANISM FOR CLEANING, LUBRICATING AND COOLING THE PRESS

[75] Inventor: Eberhard Werner, Leverkusen, Fed. Rep. of Germany

[73] Assignee: Eumuco Aktiengesellschaft für Maschinenbau, Fed. Rep. of Germany

[21] Appl. No.: 372,411

[22] Filed: Apr. 27, 1982

[30] Foreign Application Priority Data

Apr. 28, 1981 [DE] Fed. Rep. of Germany ..... 3116752

[51] Int. Cl.[3] ..... B21J 3/00

[52] U.S. Cl. ..... 72/43; 72/39; 72/342; 72/361; 72/405; 72/422; 198/495; 198/500

[58] Field of Search ..... 72/43–45, 72/41, 39, 3, 13, 361, 422, 405, 342; 198/621, 494, 500, 488

[56] References Cited

U.S. PATENT DOCUMENTS

| | | | |
|---|---|---|---|
| 2,183,287 | 12/1939 | Candee | 72/45 |
| 2,679,816 | 6/1954 | Moore | 72/45 |
| 3,044,330 | 7/1962 | Roberts | 72/13 |
| 3,557,601 | 1/1971 | Schüssler | 72/422 |
| 3,760,957 | 9/1973 | Berger | 72/405 |
| 3,824,833 | 7/1974 | Bachmann | 72/361 |
| 3,834,213 | 9/1974 | Henzler et al. | 72/405 |

FOREIGN PATENT DOCUMENTS

| | | | |
|---|---|---|---|
| 529173 | 5/1957 | Belgium | 72/407 |
| 749010 | 5/1956 | United Kingdom | 72/45 |
| 727301 | 4/1980 | U.S.S.R. | 72/45 |

*Primary Examiner*—Daniel C. Crane
*Attorney, Agent, or Firm*—Neil F. Markva

[57] ABSTRACT

The article handling assembly includes a lifting beam having a support with a plurality of workpiece grasping members. The support is moved inwardly and outwardly with respect to the work stations of the forging press. A spraying mechanism is also provided to move inwardly and outwardly with respect to the work stations of the forging press. A control mechanism operates the movement of the lifting beam having the workpiece grasping members effecting movement from one work station to the next. The movement is effected along the length of the forging press work stations outside of the area of the work stations. The movement of the spraying mechanism into and out of the work stations is synchronized with the movement of the workpiece grasping members moving into and out of the work stations to initially grasp workpieces and then to release the workpieces in the next work station. These operations are effectuated while the forging press is in an open position. Thus, each time workpieces are moved, the spraying device enters the work stations and effectuates the function of cleaning, lubricating and cooling.

10 Claims, 4 Drawing Figures

1
2
3
4
5
6
7
8
10
11
12
13
14
15
16
17
18
19
20
21
23
24
25
26
27
28
31
32
38
39
40
55
56
57

ARTICLE HANDLING ASSEMBLY FOR FORGING PRESSES HAVING A SPRAYING MECHANISM FOR CLEANING, LUBRICATING AND COOLING THE PRESS

FIELD OF THE INVENTION

This invention relates to an article handling mechanism including a lifting beam useful with drop forging presses and the like. The article assembly mechanism includes a plurality of workpiece grasping members corresponding to the number of work stations in the forging press. The mechanism moves the workpiece grasping members into and out of the work station area while the press is in an open position. A spraying mechanism is used in combination with the article handling assembly to effectuate blasting functions performing cleaning, lubricating and cooling of the press working tools while the forging press is in an open position.

BACKGROUND OF THE INVENTION

Various embodiments of workpiece transporting devices or article handling assemblies are well known. Such assemblies are known for use in the automatic transport of workpieces from one machining point or work station to the next within a large machine such as a forging press. Thus, the workpiece is transported continually between the pressing strokes of the machine over a row of available machining points which might contain, for example, dies.

Known article handling devices are capable of operating with only one workpiece at a time within the area of the work station or pressing space. Thus, with such known article handling assemblies, the maximum possible output capacity in it is relatively low. That is, depending on the number of operations being carried out, such a prior art article handling system is capable of transporting approximately 180 to 300 pieces per hour.

Other automated article handling mechanisms move several workpieces simultaneously through the pressing space between the pressing strokes of the machine. In this situation, the output capacities range from approximately 700 to 1500 pieces per hour depending on how heavily the forging tools are being used.

There is a problem associated with the cleaning and cooling of the forging dies with respect to the prior art article handling assemblies. To have sufficient time for cleaning and cooling the forging die, only each second machining point or work station can be occupied when the forging operation necessarily involves the production of burrs on the workpieces. Such burrs necessarily must be removed to preclude damage to the machine. In all of the known article handling mechanisms, workpieces are moved from one work station to the next in a single vertical plane located along the center of the press or work station area. Considerable difficulties arise in cleaning scale from the tools and lubricating them with a spray medium for cooling if each stage in the operation is occupied by the workpiece.

The primary object of the invention is to enable the tools in the press to be sufficiently cleaned and lubricated while each machining point or work station is being used to effectuate an operation on the workpiece for each stroke of the press.

SUMMARY OF THE INVENTION

As described herein, the invention comprises an article handling assembly including a control mechanism for grasping the workpieces and retracting same out of the work station area. Movement from one work station to the next is accomplished at a location laterally displaced from the center of the press or machine. When the workpiece grasping members are in the laterally displaced position, the spraying mechanism is moved into the area of the work stations to effectuate a blast of liquid which effects cleaning, lubricating and cooling of the press tools. The movement of the spraying mechanism is synchronized with the retraction movement of the workpiece grasping members.

More specifically, with the article handling assembly of the invention, the workpieces leave the center of the press or work station area after they have been lifted away from the tools. The workpieces are then guided from one machining point or work station to the next outside of the tool area. Thus, sufficient time and space is created for cleaning, lubricating and cooling of tools such as are found in a forging die. With this type of article handling assembly, all of the work stations may be operating on a workpiece simultaneously. The workpieces are all removed from the dies or tools and retracted by the article handling mechanism. The synchronized introduction of a spraying blast into the work station area can be effected in a precise and reliable manner through the control mechanism disclosed and described herein. With each of the work stations being occupied by a workpiece during the operation of the forging press, an output capacity of approximately 700 to 1500 pieces per hour can be achieved without any possibility of debris of remaining in the forging press.

The article handling assembly of this invention comprises workpiece grasping means for carrying workpieces from one machining point or work station to the next. Lifting beam means effect movement of the workpiece grasping means sequentially along and outside of the work stations of the forging press. A spraying mechanism is mounted to move into the work stations of the forging press for effecting a blast of cooling, lubricating and cleaning fluid medium. Control means effect movement of the spraying mechanism into the work stations while the work piece grasping means is located outside the work stations during the transport of workpieces from one work station to the next.

The article handling assembly includes a control housing having a rotatably driven shaft fitted with pairs of cams used to control the transporting process associated with the lifting and moving of the work pieces and the movement of the spraying mechanism. Cam followers are attached to control linkage mechanisms operating hydraulic control cylinders that are hydraulically linked to further hydraulic cylinders effecting the movement of the workpiece grasping members and the spraying mechanism into and out of the area of the work stations. The shape of the cams fitted to the same driven shaft member results in a synchronized movement of the workpiece grasping members with respect to the spraying mechanism thereby providing a very simple structure and at the same time reliability in the function of the operating processes.

A particular feature of the invention is to have the control means for both the article handling mechanism and the spraying mechanism located on the same control housing. For this purpose, the shaft of the control housing comprises a pair of cams with linkage acting on a hydraulic control cylinder. The hydraulic control cylinder is hydraulically coupled to the hydraulic cylinder of the spraying mechanism. Such a hydraulic coupling in the retraction of the grasping members from the work station and in the movement of the spraying mechanism guarantees perfectly synchronous movement of the individual assemblies with respect to each other. In particular, a freedom of space is achieved in the vicinity of the forging press work stations.

Another feature of the invention is to enable the rotation of the workpieces during their movement from one work station to the next. Such rotation may be effected around 90° or 180° through the rotation of the workpiece grasping members around their longitudinal axis. Such rotation of the workpiece by the workpiece grasping member is effected outside of the work station area while the article is being transported. Thus, the forging tools remain free of workpieces so that the entire time required by the workpiece grasping members for withdrawal, stepping movement and travel into the center of the press can be used for cleaning and lubricating the forging press tools.

A further feature of the invention is directed to the use of a workpiece sensing device. Such a device includes a temperature measuring device mounted to sense the presence of workpieces within the work stations while the press is in an open position. The temperature measuring device is electrically connected to a monitoring and switching mechanism to activate the control means of the article handling assembly when a workpiece is sensed in a work station. This sensing is accomplished while the press is in an open position and the workpiece grasping means is outside the work stations. Such a feature avoids the possibility of damage to the article handling lifting beam and the forging press dies in the event that workpiece is left, unintentionally in the work station area.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
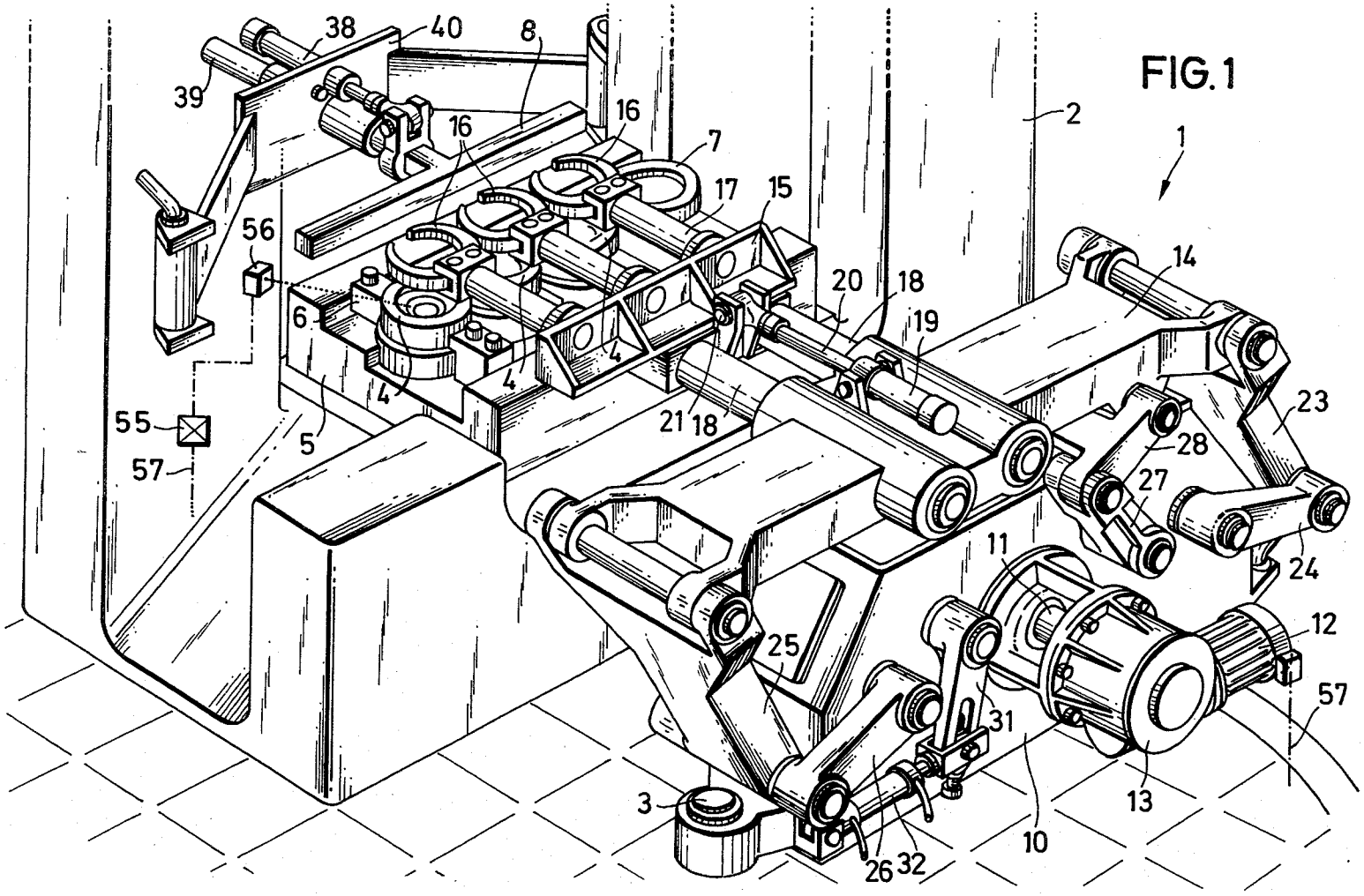
FIG. 1 is a perspective view of an article handling assembly made in accordance with the invention.

The article handling assembly, generally designated 1, is pivotally mounted with anchoring means 3 in front of drop forging press 2. Thus assembly 1 may be pivoted away from press 2 to permit the exchange of tools such as dies or similar components. Assembly 1 has no mechanical connections to press 2. The lower portion of press 2 includes a row of tools such as dies 4*a*, 4*b*, and 4*c*. Clamping elements 6 secure dies 4*a*, 4*b* and 4*c* to base plate 5. An inserting device (not shown) places a heated workpiece into die 4*a* to begin the automatic forging operation. Assembly 1 then transports the workpiece to the remaining work stations of press 2. Burr-removing device 7 trims the forged parts in a downward direction in the last work station of press 2. Burrs are removed from burr-removing device 7 by a separate device (not shown).

A blasting and spraying head 8 is movably mounted on press 2 opposite the article handling device 1. Head 8 moves horizontally over the work stations of press 2 to effect cleaning and cooling of the tools located therein.

Article handling assembly 1 includes a control housing 10 having a shaft 11 driven by an electric motor 12 via gearing 13. The speed of shaft 11 may be preselected within a wide range. The drive is switched on and runs continually once movement of the workpieces begins. However, the drive may be effected at various speeds as necessary during a complete cycle of the operation. Linkage mechanisms 23, 24 and 25, 26 movably connect lifting beam 14 to control housing 10. Cams disposed on shaft 11 are used to control the movement of lifting beam 14. Grasping members 16 are carried by holders 17 and mounted to support 15. Holders 17 accommodate a mechanism for moving the limbs of holder 17 and effecting rotation thereof around the longitudinal axis. Such a mechanism is known. A hydraulic cylinder 19 is used to displace support 15 movably mounted on guides 18. Piston rod 20 of cylinder 19 is hingedly connected to support 15 at pivot pin 21.

Pull lever 27 is connected to lifting beam 14 by control strap 28. Control lever 27 coacts with a pair of cams (not shown) arranged on shaft 11 and controls the longitudinal displacement of lifting beam 14 mounted by linkage members 23, 24 and 25, 26. Grasping members 16 move with lifting beam 14. Upon one complete rotation of control cams mounted on shaft 11, lifting beam 14 effects movement of grasping member 16 from the center of one die to the center of the next and back again. Thus, a complete backward and forward stepping movement is effected. A further pair of cams mounted on shaft 11 may be used to effect vertical movement of lifting beam 14. Upon one revolution of such cam members, lifting beam 14 is moved vertically upward once and down again. The cams effecting movement of control lever 27 and control strap 28 are not shown.

Figure 3:
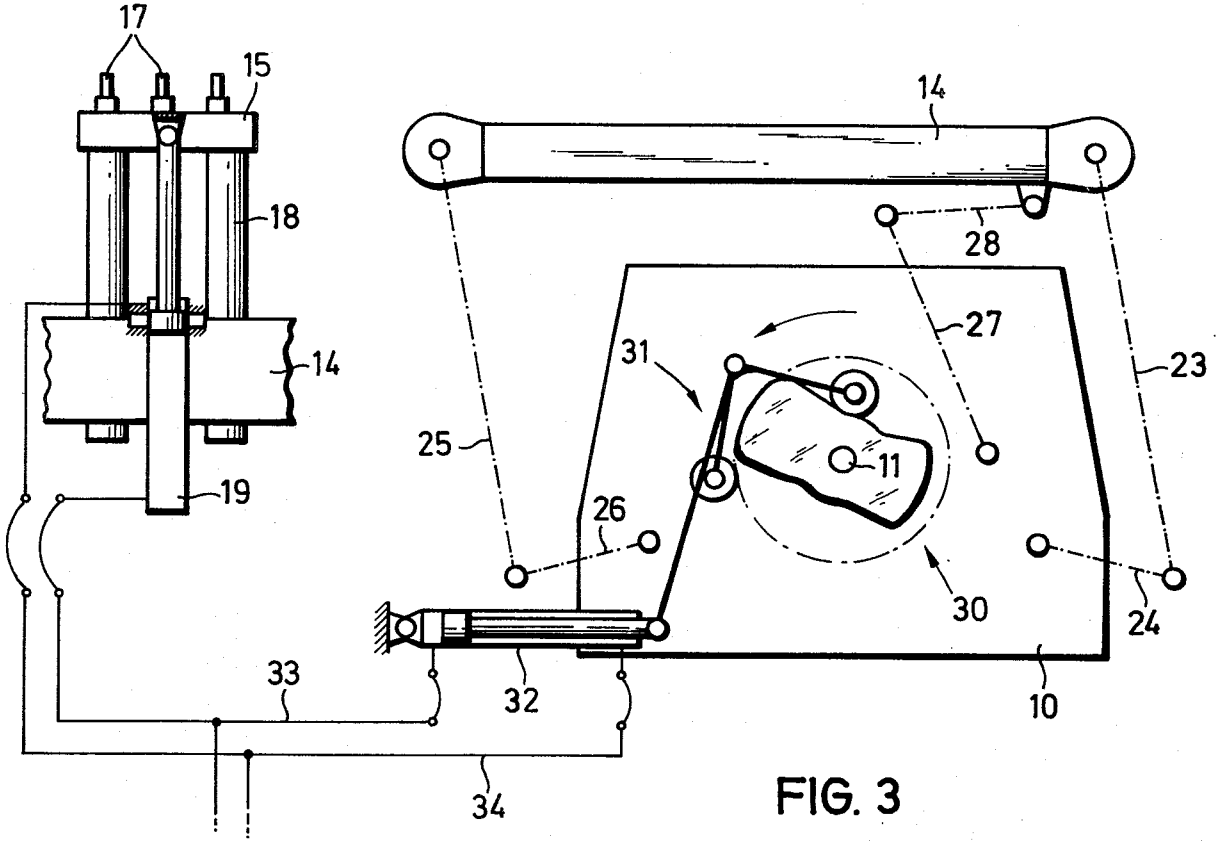
FIG. 3 is a schematic elevational view of a control mechanism for moving the grasping member support assembly; and, FIG. 4 is an elevational schematic view of a control mechanism for effecting operation of a blasting and spraying assembly.

FIG. 3 shows a pair of cams 30 having a main and counter cam surface for controlling a lever linkage 31 mounted to control housing 10. Hydraulic cylinder 32 is moved via linkage 31 to hydraulically control the cylinder 19. This causes longitudinal displacement of support 15 with grasping members 16 thereby effecting the movement of grasping members 16 into and out of the working stations of press 2. Hydraulic oil forced out of the front cylinder chamber of cylinder 32 reaches into the front cylinder chamber of cylinder 19 via tube connection 33. At the same time, the respective rear cylinder chambers of cylinders 32 and 19 are connected via tube line 34.

Figure 4:
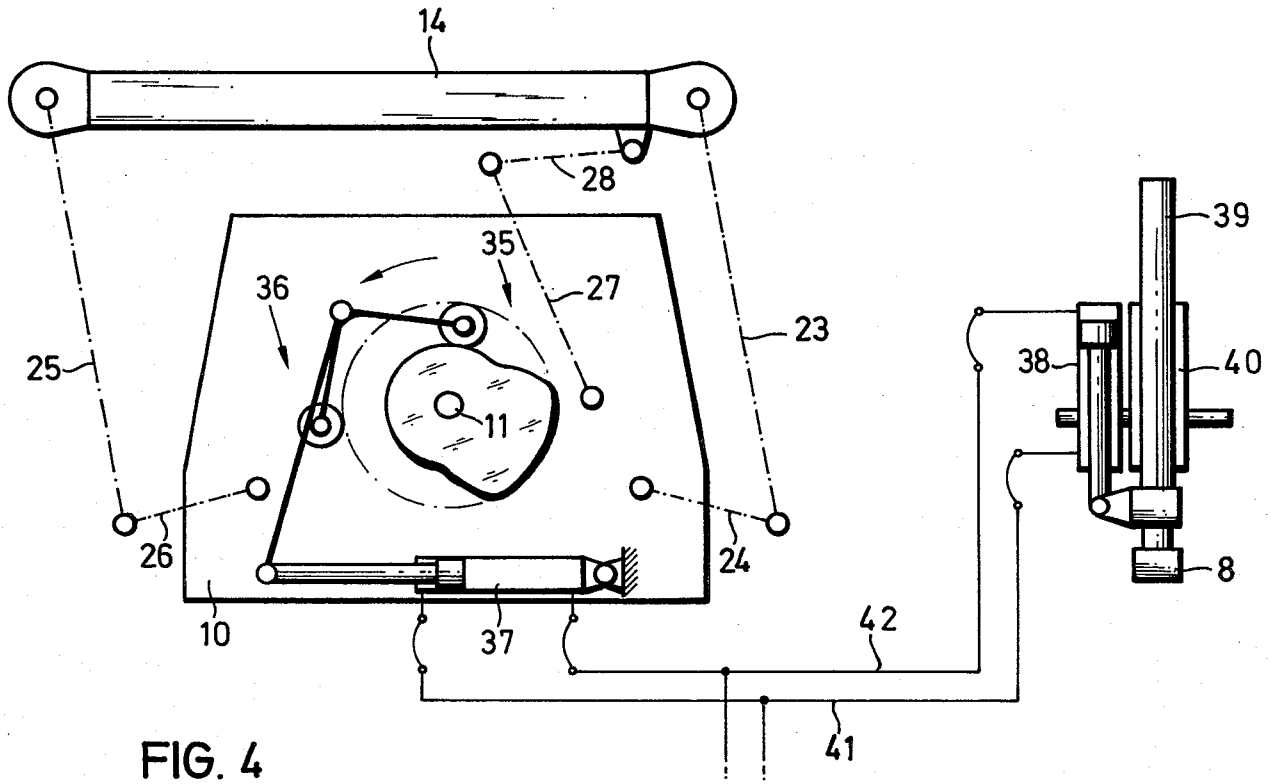

In FIG. 4, a hydraulic cylinder 37 is shown mounted on the side of the control housing 10 facing press 2. A pair of cams 35 mounted on shaft 11 controls lever mechanism 36 acting on cylinder 37. Hydraulic cylinder 38 operates blasting and spraying head 8 and is hydraulically coupled to hydraulic cylinder 37. Blasting and spraying head 8 is movably mounted in support 40 via guide 39. The front cylinder chamber of cylinder 37 is connected to the front cylinder chamber of cylinder 38 via tube line 41. The rear cylinder chamber of hydraulic cylinder 37 is connected to rear cylinder chamber of cylinder 38 via tube line 42. This hydraulic connection effects movement of the blasting and spraying head 8 in a direction toward the center of press 2 and then away from it.

Figure 2:
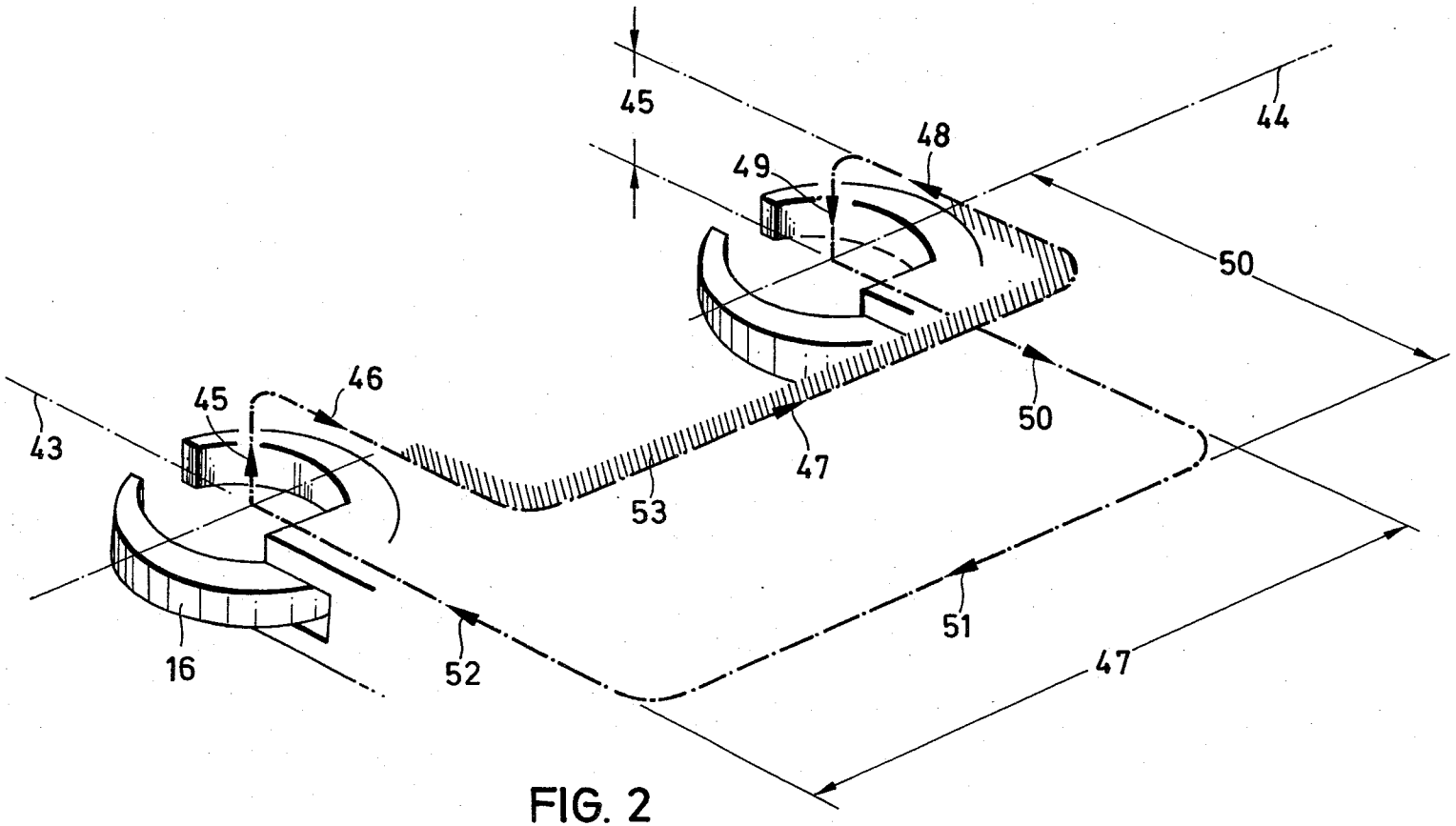
FIG. 2 is a diagrammatic representation of the transporting movement for the grasping members in the assembly of the invention.

The control mechanism of FIG. 3 effects movement of each grasping member 16 along a path and in a manner as shown in FIG. 2. Lines 43 and 44 represent a starting position through the center of a die 4*a* and the center of the press work stations, respectively. Grasping member 16 is first closed around the work piece and makes a vertical lift 45. The workpiece is then transferred outwardly from the centerline 44 with a retraction movement 46. Once completed, the workpiece is then carried to the center of the next tool along the length or step 47 as shown. The workpiece is then moved inwardly to the next work station with the return movement 48 and moved downwardly via lowering movement 49.

In the lowered position, grasping member 16 is opened to release the workpiece and then embarks along the return path 50 and 51. As the grasping member 16 moves along path 51, the pressing stroke of the forge operation is effectuated. Once the pressing stroke of the forge is completed, grasping member 16 then moves along path 52 toward the center of the die and center of the press to pick up the next workpiece and repeat the operation.

Thus, upon one complete rotation of shaft 11 carrying the associated pairs of cams, grasping elements 16 will have transferred a workpiece along path 45, 46, 47, 48 and 49 from a first work station to the next. Then, the open grasping member 16 will have returned along path 50, 51, 52 to the center of the next previous work station. The grasping members 16 having the workpiece contained therein are moved along the shaded portion of path 46, 47, 48 during the forward stepping movement. During this time, the blasting and spraying head 8 is moved into the pressing space toward the center of the press for effecting the cleaning operation along the work stations. Because the hydraulic control cylinders 37 and 38 are hydraulically coupled together, blasting and spraying head 8 may be guided in and out of the press with a guaranteed sychronous movement. This movement occurs while the workpieces are carried along the shaded area 53 on path 46, 47, 48. The retraction of the grasping members 16 may be controlled to any desired extent. The pair of control cams 30 shown in FIG. 3 effect the movement of the retraction of the grasping members to the next tool and the return of those grasping members 16 as described above.

In some instances, it is necessary to rotate the parts being forged through 90° or 180° between the individual work stations. Thus, grasping members 16 may be rotatable around their longitudinal axis through the mechanism contained in holder 17. Workpiece rotation is effected during the movement along path 46, 47, 48 to the next work operation while the workpieces are outside the center of press 2.

A monitoring device 55 is responsive to a signal from a temperature measuring device 56 located outside the press. The temperature measuring device 56 is aligned onto the center of each die and locates any part or workpiece that has not been accepted in the die. That is, temperature sensing device 56 determines in a non-contact manner whether a heated workpiece is properly located in the die for the forging operation. The monitoring is carried out while the grasping members 16 are operating during the transport phase of the handling operation. If it is determined that a workpiece still remains in the die or is not properly located within the die, measuring device 56 sends signal to monitoring device 55 and the motor 12 is stopped via control line 57. Simultaneously, the pressing stroke of the forging press is stopped.

While the article handling assembly for forging presses has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. An article handling assembly for a forging press having a plurality of work stations and a spraying mechanism for said work stations, said assembly comprising:

(a) plural workpiece grasping means for carrying workpieces, (b) means for effecting movement of the plural workpiece grasping means sequentially along and outside of the work stations of the forging press and for moving the plural workpiece grasping means into and out of the work stations of the forging press, (c) means for moving the spraying mechanism into the work stations of the forging press, and (d) control means for effecting movement of the spraying mechanism into the work stations while the plural workpiece grasping means is located outside the work stations during the transport of workpieces from one work station to the next, (e) said spraying mechanism is disposed adjacent to the work stations opposite to said plural workpiece grasping means and reciprocates toward and away from said work stations, (f) said reciprocation motion of the spraying mechanism being synchronous and in opposite phase with respect to the movement of the plural workpiece grasping means into and out of the work stations of the forging press.

2. An assembly as defined in claim 1, further comprising:

a control housing having a rotatably driven shaft, and lifting means for supporting said plural workpiece grasping means and being connected to the housing via control linkage mechanisms, said control means includes a pair of cams fixedly mounted to the driven shaft and operating a hydraulic control cylinder located on the control housing and used for operation of the plural workpiece grasping means, said movement effecting means for the plural workpiece grasping means includes a hydraulic cylinder hydraulically connected to the hydraulic control cylinder of the control means.

3. An assembly as defined in claim 2 wherein said control means includes a further pair of cams fixedly mounted to the driven shaft and operating a further hydraulic control cylinder located on the control housing and used for operation of the spraying mechanism, said movement effecting means for the spraying mechanism includes a hydraulic cylinder, hydraulically connected to the further hydraulic control cylinder of the control means.

4. An assembly as defined in any one of the preceding claims 1, 2 or 3 wherein the plural workpiece grasping means includes means for rotating the workpieces while transporting the workpieces outside the work station at the forging press.

5. An assembly as defined in any one of the preceding claims 1, 2 or 3 wherein a temperature measuring device is mounted to sense the presence of workpieces within the work stations while the press is in an open position, said temperature measuring device being electrically connected to a monitoring and switching mechanism to deactivate the control means of the article handling assembly when a workpiece is sensed in a work station while the press is in an open position and the plural workpiece grasping means is outside the work stations.

6. An assembly as defined in claim 1 wherein said spraying mechanism extends along a plurality of the work stations and performs cleaning, luricating and cooling functions.

7. An assembly as defined in claim 2 wherein said housing is pivotally anchored to a support surface away from the forging press and pivots about a vertical axis.

8. An assembly as defined in claim 7 wherein said control means comprises a driven shaft, cam means fixedly mounted on the driven shaft, hydraulic control cylinders and cam follower means linked to the hydraulic control cylinders, said movement effecting means for the plural workpiece grasping means and the spraying means include hydraulic cylinders hydraulically coupled to the hydraulic control cylinders of the control means.

9. An assembly as defined in claim 8 wherein said cam means includes a first pair of cams effective to move said plural workpiece grasping means via a first cam follower into and out of the work stations of the forging press.

10. An assembly as defined in claim 9 wherein said cam means includes a second pair of cams effective to move said spraying mechanism via a second cam follower into and out of the work stations of the forging press.

* * * * *